US011029718B2

(12) United States Patent
Eberlein

(10) Patent No.: US 11,029,718 B2
(45) Date of Patent: Jun. 8, 2021

(54) LOW NOISE BANDGAP REFERENCE APPARATUS

(71) Applicant: Intel Corporation, Santa Clara, CA (US)

(72) Inventor: Matthias Eberlein, Holzkirchen (DE)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/721,521

(22) Filed: Sep. 29, 2017

(65) Prior Publication Data

US 2019/0101948 A1 Apr. 4, 2019

(51) Int. Cl.

| | |
|---|---|
| ***G05F 3/30*** | (2006.01) |
| ***G05F 3/22*** | (2006.01) |
| ***G05F 3/26*** | (2006.01) |

(52) U.S. Cl.

CPC ..... *G05F 3/30* (2013.01); *G05F 3/225* (2013.01); *G05F 3/267* (2013.01)

(58) Field of Classification Search

CPC ..... G05F 3/30; G05F 3/225; G05F 3/267

See application file for complete search history.

(56) References Cited

U.S. PATENT DOCUMENTS

2004/0155700 A1* 8/2004 Gower ..... G05F 3/30 327/543
2005/0206443 A1* 9/2005 Chatal ..... G05F 3/267 327/538
2005/0285666 A1 12/2005 Garlapati et al.
2008/0042737 A1* 2/2008 Kim ..... G05F 3/30 327/539
2009/0302823 A1* 12/2009 Chao ..... G05F 3/30 323/313
2011/0140769 A1* 6/2011 Visconti ..... G05F 3/30 327/543
2013/0200878 A1* 8/2013 Kalb ..... G05F 3/16 323/313
2014/0266139 A1* 9/2014 Eberlein ..... G05F 3/16 323/313

(Continued)

FOREIGN PATENT DOCUMENTS

EP 3136199 3/2017

OTHER PUBLICATIONS

Banba, H. et al., "A CMOS Bandgap Reference Circuit with Sub-1-V Operation", IEEE Journal of Solid-State Circuits, vol. 34, No. 5, May 1999, pp. 670-674 (5 pages).

(Continued)

*Primary Examiner* — Jue Zhang
(74) *Attorney, Agent, or Firm* — Green, Howard & Mughal LLP

(57) ABSTRACT

An apparatus is provided which includes: a first supply node; a second supply node; a first transistor coupled to the first supply node, the first transistor is to provide a first current which is complementary to absolute temperature (CTAT); a second transistor coupled to the first supply node, the second transistor is to provide a second current which is proportional to absolute temperature (PTAT); a resistive device coupled in series at a node with the first and second transistors, and coupled to the second supply node, wherein the node is to sum the CTAT and the PTAT currents.

30 Claims, 11 Drawing Sheets

(56) References Cited

U.S. PATENT DOCUMENTS

| | | | | |
|---|---|---|---|---|
| 2017/0131736 | A1* | 5/2017 | Acar | G05F 3/267 |
| 2017/0139435 | A1 | 5/2017 | Arnold et al. | |

OTHER PUBLICATIONS

Fayomi, C. et al., "Sub 1 V CMOS Bandgap Reference Design Techniques: a Survey", Analog integr Circ Sig Process (2010) 62: 141-157 DOI 10.1007/s10470-009-9352-4 (Received Apr. 5, 2007).
Hu, J. et al., "Design of a High-performance Brokaw Band-Gap Reference", International Conference on ASID, 2010, pp. 126-129 (4 pages).
International Search Report and Written Opinion from PCT/US2018/048635 dated Dec. 14, 2018, 15 pgs.
International Preliminary Report on Patentability from PCT/US2018/048635 dated Apr. 9, 2020, 12 pgs.

* cited by examiner

LOW NOISE BANDGAP REFERENCE APPARATUS

BACKGROUND

Semiconductor bandgap voltage reference (BVR) circuits are used to a great extent as voltage references for operating voltages in analog, digital and mixed analog-digital circuits. BVR circuits which are accurate and stable versus temperature, supply voltage and manufacturing variations are desirable. Further, BVR circuits are desired to be inexpensive and capable of allowing some load current connected to the output. Still further, in some applications BVR circuits are desired to provide low output reference voltages. One challenge for BVRs is to realize a circuit that simultaneously provides low noise and sub-1V operation.

BRIEF DESCRIPTION OF THE DRAWINGS

The embodiments of the disclosure will be understood more fully from the detailed description given below and from the accompanying drawings of various embodiments of the disclosure, which, however, should not be taken to limit the disclosure to the specific embodiments, but are for explanation and understanding only.

DETAILED DESCRIPTION

Figure 1:
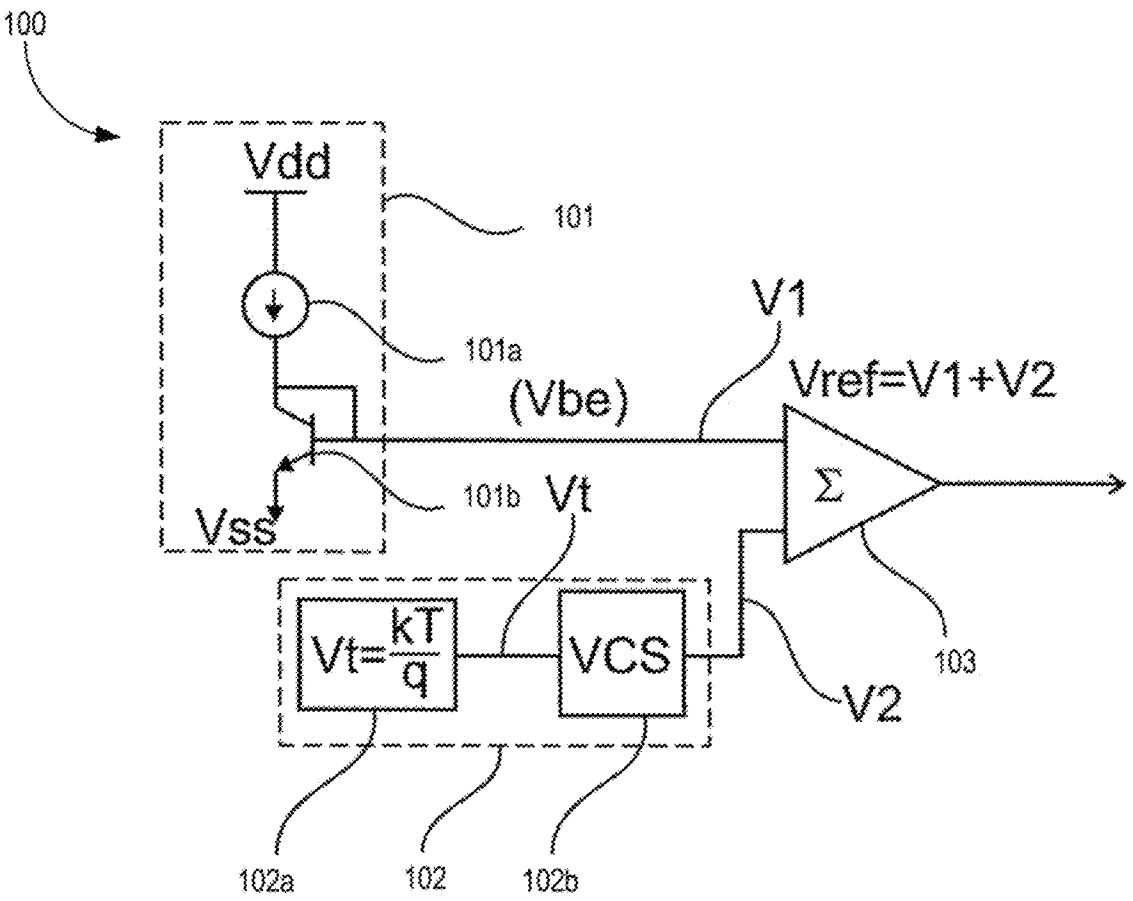
FIG. 1 illustrates a schematic of a bandgap voltage reference (BVR) circuit, according to some embodiments.

Conventional BVR circuits operate on the principle of the addition of two partial voltages with opposite temperature responses. While one partial voltage rises proportionately with the absolute temperature (PTAT partial voltage, also referred to as "proportional to absolute temperature"), the other partial voltage falls as the temperature rises (CTAT partial voltage, also referred to as "complementary to absolute temperature"). An output voltage with low sensitivity is obtained as the sum of these two partial voltages.

High frequency systems, analog-to-digital converters (ADCs), voltage regulators, etc. need precision voltage references with extremely low noise figure, so that phase-noise requirements of circuits (e.g., transceivers) can be fulfilled. With increasing bandwidth of transmitters and further process scaling, the system demands even higher performance and tighter specifications, but especially low supply (e.g., less than 1.0 Volt). One challenge is to realize low noise and sub-1V operation at once.

Some solutions for power supply (Vdd) below the silicon bandgap (approximately 1.2 V) use a current mode approach. But the current mode approach may not achieve low noise due to the mismatch and low precision in its differential pair transistors implemented as metal oxide semiconductor devices. Flicker noise (also referred to as 1/f noise) is a major issue for current mode approaches, because filtering at low frequencies (e.g., frequencies less than 10 kHz) or chopping techniques are not feasible on-chip. Chopping techniques may result in cross-talk, which is an additional noise source. Alternative known circuits with bi-polar junction transistor (BJT) devices may not operate at lower power supplies (e.g., Vdd less than 1.3 V), and are sensitive to device parameters (e.g., low beta).

Various embodiments describe a low-noise low-voltage bandgap reference circuit that uses BJT devices (e.g., NPN transistors) for proportional to absolute temperature (PTAT) and complementary to absolute temperature (CTAT) current generation and loop amplification at once. This facilitates low 1/f-noise and approximately zero-offset. In some embodiments, current mode technique allows for realization of a reference with minimum supply (e.g., 0.9 V or less). In some embodiments, combination of PTAT and CTAT currents ensure that non-idealities of process/BJT parameters (e.g., low beta) are cancelled. In some embodiments, parasitic BJT devices available in any triple-well process can be used for realizing the BJT devices for the low-voltage low-noise bandgap circuit.

There are many technical effects of the bandgap reference circuit of the various embodiments. For example, compared to traditional bandgap reference circuits, here lowest 1/f-noise and low thermal noise at minimum power is realized. The bandgap reference circuit of various embodiments is functional at Sub-1V supply. For example, the bandgap reference circuit can operate at a theoretical limit of Vbe+Vds of approximately 0.90 V. The bandgap reference circuit of various embodiments is a simple circuit, and its simplicity allows for relatively easy and small layout due to low resistor count and relaxed transistor matching requirement. The bandgap reference circuit is a high precision circuit (e.g., approximately +/−1% without trimming). Other technical effects will be evident from the various figures and embodiments.

In the following description, numerous details are discussed to provide a more thorough explanation of embodiments of the present disclosure. It will be apparent, however, to one skilled in the art, that embodiments of the present disclosure may be practiced without these specific details. In other instances, well-known structures and devices are shown in block diagram form, rather than in detail, in order to avoid obscuring embodiments of the present disclosure.

Note that in the corresponding drawings of the embodiments, signals are represented with lines. Some lines may be thicker, to indicate more constituent signal paths, and/or have arrows at one or more ends, to indicate primary information flow direction. Such indications are not intended to be limiting. Rather, the lines are used in connection with one or more exemplary embodiments to facilitate easier understanding of a circuit or a logical unit. Any represented signal, as dictated by design needs or preferences, may actually comprise one or more signals that may travel in either direction and may be implemented with any suitable type of signal scheme.

Throughout the specification, and in the claims, the term "connected" means a direct connection, such as electrical, mechanical, or magnetic connection between the things that are connected, without any intermediary devices.

The term "coupled" means a direct or indirect connection, such as a direct electrical, mechanical, or magnetic connection between the things that are connected or an indirect connection, through one or more passive or active intermediary devices.

The term "circuit" or "module" may refer to one or more passive and/or active components that are arranged to cooperate with one another to provide a desired function. The term "signal" may refer to at least one current signal, voltage signal, magnetic signal, or data/clock signal. The meaning of "a," "an," and "the" include plural references. The meaning of "in" includes "in" and "on."

The term "scaling" generally refers to converting a design (schematic and layout) from one process technology to another process technology and subsequently being reduced in layout area. The term "scaling" generally also refers to downsizing layout and devices within the same technology node. The term "scaling" may also refer to adjusting (e.g., slowing down or speeding up—i.e. scaling down, or scaling up respectively) of a signal frequency relative to another parameter, for example, power supply level. The terms "substantially," "close," "approximately," "near," and "about," generally refer to being within +/−10% of a target value.

Here, the term "bandgap" as used in the BVR does not imply that the output reference voltage Vref is near to the bandgap voltage of the semiconductor material, e.g., around 1.25 V corresponding to the bandgap voltage of silicon. In contrast, as exemplified above, Vref may be significantly lower than the semiconductor material bandgap voltage.

Unless otherwise specified the use of the ordinal adjectives "first," "second," and "third," etc., to describe a common object, merely indicate that different instances of like objects are being referred to, and are not intended to imply that the objects so described must be in a given sequence, either temporally, spatially, in ranking or in any other manner.

For the purposes of the present disclosure, phrases "A and/or B" and "A or B" mean (A), (B), or (A and B). For the purposes of the present disclosure, the phrase "A, B, and/or C" means (A), (B), (C), (A and B), (A and C), (B and C), or (A, B and C).

The terms "left," "right," "front," "back," "top," "bottom," "over," "under," and the like in the description and in the claims, if any, are used for descriptive purposes and not necessarily for describing permanent relative positions. For the purposes of present disclosure the terms "spin" and "magnetic moment" are used equivalently. More rigorously, the direction of the spin is opposite to that of the magnetic moment, and the charge of the particle is negative (such as in the case of electron).

For purposes of the embodiments, the transistors in various circuits and logic blocks described here are metal oxide semiconductor (MOS) transistors or their derivatives, where the MOS transistors include drain, source, gate, and bulk terminals. The transistors and/or the MOS transistor derivatives also include Tri-Gate and FinFET transistors, Gate All Around Cylindrical Transistors, Tunneling FET (TFET), Square Wire, or Rectangular Ribbon Transistors, ferroelectric FET (FeFETs), or other devices implementing transistor functionality like carbon nanotubes or spintronic devices. MOSFET symmetrical source and drain terminals i.e., are identical terminals and are interchangeably used here. A TFET device, on the other hand, has asymmetric Source and Drain terminals. Those skilled in the art will appreciate that other transistors, for example, Bi-polar junction transistors (BJT PNP/NPN), BiCMOS, CMOS, etc., may be used without departing from the scope of the disclosure.

It is pointed out that elements of a figure having the same reference numbers (or names) as the elements of any other figure can operate or function in any manner similar to that described, but are not limited to such.

FIG. 1 illustrates a schematic of BVR 100, according to some embodiments. BVR circuit 100 provides a temperature and supply insensitive output voltage. BVR circuits are used to a great extent as voltage references for operating voltages in analog, digital and mixed analog-digital circuits. For example, they are used in integrated circuits (ICs) and memory devices such as dynamic random access memories (DRAM), flash memories, power supply generation devices, DC bias voltage devices, current sources, analog-to-digital converters (ADCs), and digital-to-analog converters (DACs). A BVR circuit may, for instance, provide an IC reference voltage. The reference voltage is, for instance, accurate and stable versus temperature, supply, and manufacturing variations. Further, BVR circuits may be compatible with standard CMOS processing. For example, MOSFETs and NPN bipolar junction transistors (BJT) available in standard CMOS processes can be used to implement the BVR circuit.

In conventional BVR circuits, an output reference voltage Vref is obtained based on a voltage that is proportional to absolute temperature (PTAT) and a voltage with negative temperature coefficient, which is complementary to absolute temperature (CTAT). As the temperature coefficients of these two voltages are opposite, a certain composition of the PTAT voltage and the CTAT voltage is constant versus temperature.

In various embodiments, BVR circuit 100 is configured to work for supply voltages Vdd of, e.g., Vdd less than or equal to 1.20 V. For instance, BVR circuits can be configured to be operated by a supply voltage Vdd of less than e.g. 1.20 V, 1.00 V, 0.90 V, 0.80 V. In various embodiments, BVR circuit 100 may be configured to generate reference voltages Vref of, e.g., Vref less than 1.20 V. For instance, BVR circuit 100 can be configured to generate reference voltage Vref of less than e.g. 1.20 V, 1.00 V, 0.90 V, 0.80 V, etc.

BVR circuit 100 may comprise a first circuit section 101 configured to generate a CTAT voltage V1, a second circuit section 102 configured to generate a voltage V2, and a combiner 103 configured to generate the reference voltage Vref=V1+V2. The CTAT voltage V1 generated by the first circuit section 101 may be obtained from the voltage across a forward biased p-n junction or the base-emitter voltage Vbe of a diode-connected BJT 101*b*. Here, Vdd denotes the positive supply voltage, Vss denotes the negative supply voltage, e.g. ground, and reference numeral 101*a* denotes a current source connected in series with BJT 101*b* between Vdd and Vss.

The second circuit section 102, which provides the voltage V2, may comprise a thermal voltage generation stage 102*a* and a voltage conversion stage (VCS) 102*b*. The voltage conversion stage 22 may have an input connected to an output of the thermal voltage generation stage 102*a*. The thermal voltage generation stage 102*a* may produce a thermal voltage Vt=kT/q, where 'k' is the Boltzmann constant, 'q' is the electron charge, and 'T' is the temperature. Thus, the temperature coefficient of the thermal voltage Vt is k/q. Typically, k/q is too small to compensate for the complementary temperature behavior of the CTAT voltage V1.

Thermal voltage Vt may be fed into the voltage conversion stage 102*b* and converted therein into the voltage V2.

In conventional BVR circuits, the voltage conversion stage 102*a* is a mere amplification stage. For example, the thermal voltage Vt is amplified by a factor 'K' to obtain the required PTAT voltage equal to K·Vt. The amplification factor 'K' is adjusted to allow the PTAT voltage K·Vt to compensate the temperature behavior of the CTAT voltage V1. CTAT voltage V1 and voltage V2 are combined in combiner 30 to generate the reference voltage Vref. Combiner 30 may, e.g., be an adder. For instance, Vref may be generated by combining, in particular adding, V1 and V2, or a faction of both voltages.

Figure 2:
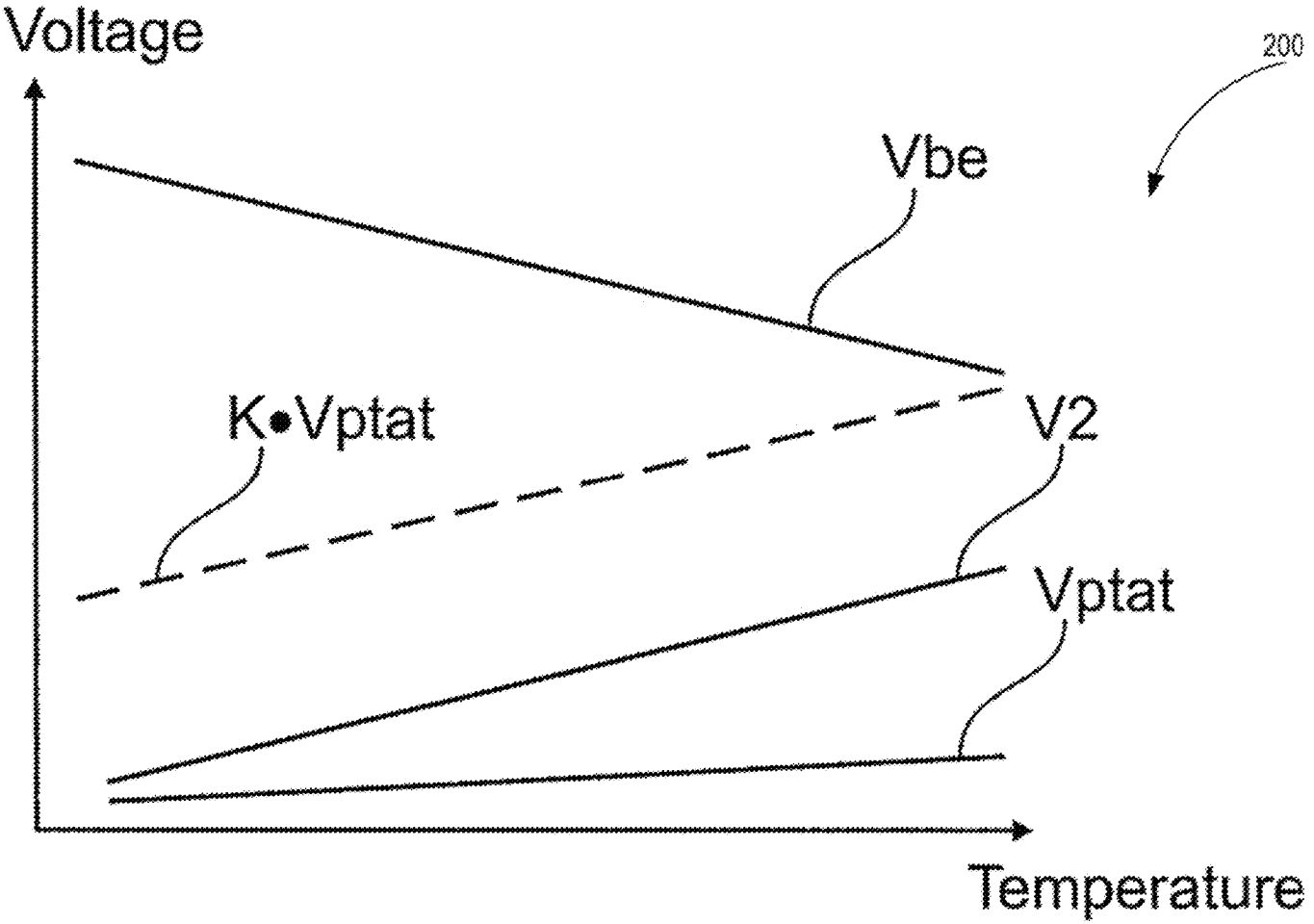
FIG. 2 illustrates a plot showing a voltage versus temperature behavior of partial voltages provided in a BVR circuit.

FIG. 2 illustrates plot 200 showing a voltage versus temperature behavior of partial voltages provided in a bandgap voltage reference circuit. FIG. 2 illustrates the temperature behavior of the voltages referred to above. In a standard bandgap concept (Vt=Vptat), Vptat is linearly amplified to K·Vptat in order to obtain the opposite temperature coefficient of the CTAT voltage Vbe. In contrast, the same temperature coefficient may be generated with the voltage V2 having, however, a significantly smaller absolute value than K·Vt at a given temperature T.

Returning to FIG. 2, the reference voltage Vref may be generated at the output of an amplification stage. Therefore, it may exhibit a low output impedance and can deliver any current to the external load circuitry. Further, it is to be noted that the reference voltage Vref may stay unchanged for varying base-currents of the BJT transistors $Q_1$ and/or $Q_2$, as discussed with reference to FIGS. 3-4.

Figure 3A:
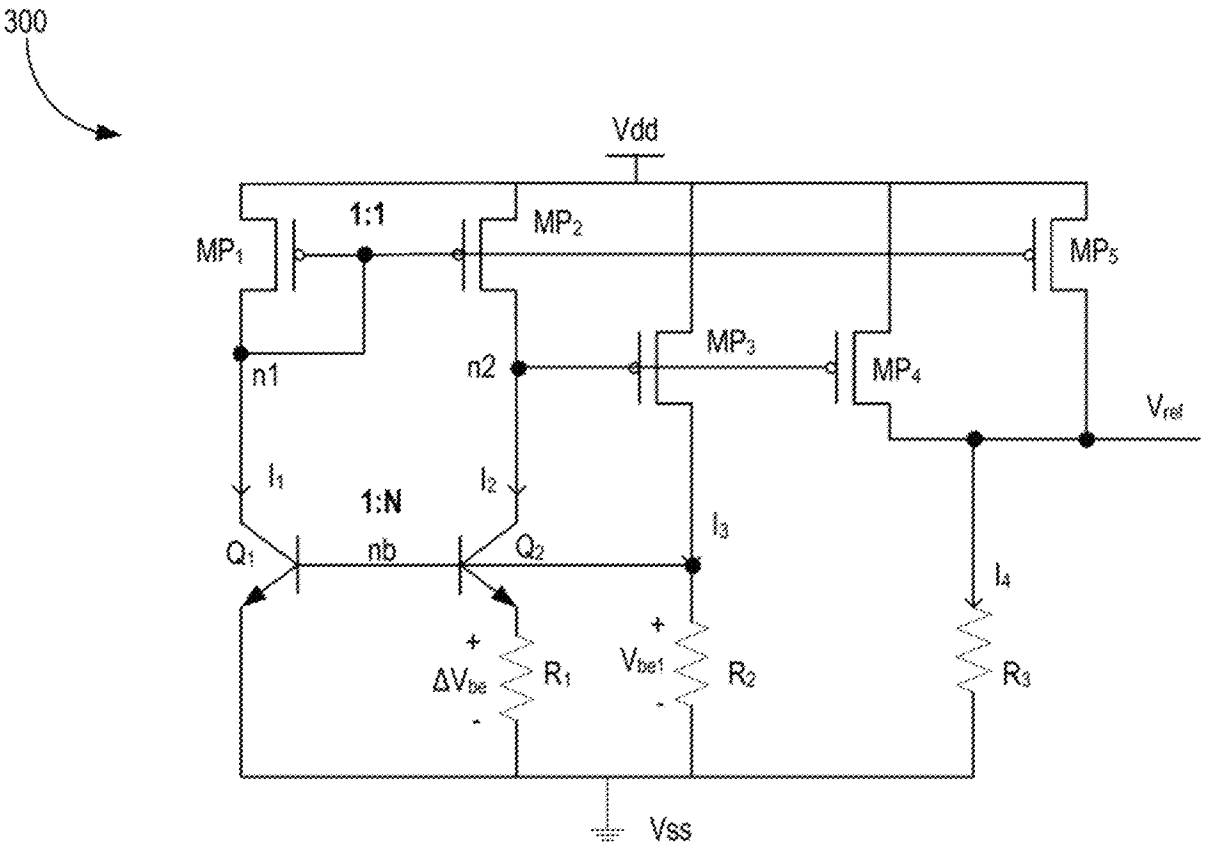
FIGS. 3A-B illustrate low noise sub-1V BVRs using NPN bi-polar junction transistors (BJTs), respectively, according to some embodiments of the disclosure.
Figure 3B:
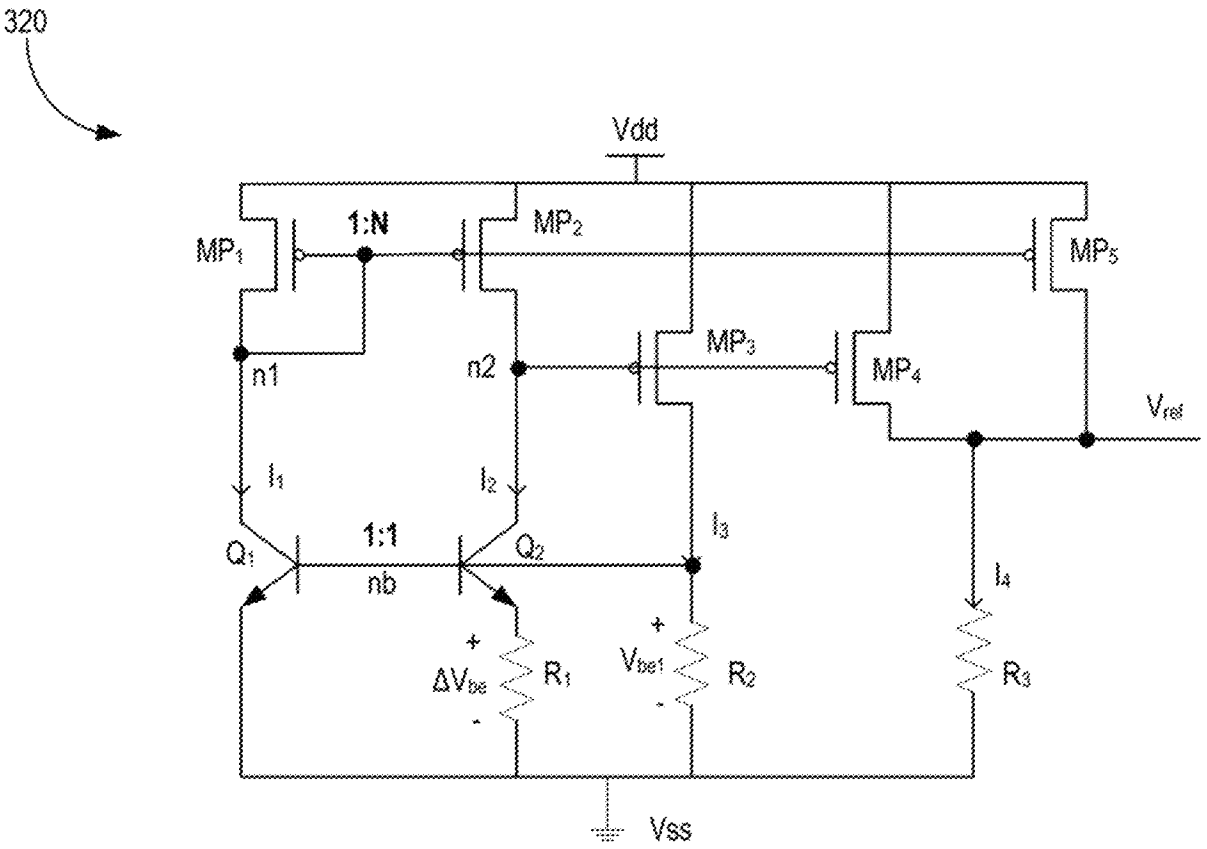

FIGS. 3A-B illustrate low-noise sub-1V bandgap reference circuits 300 and 320 using NPN BJTs, respectively, according to some embodiments of the disclosure. In some embodiments, bandgap reference circuit 300 generates a ground supply referenced reference voltage Vref, and comprises a current mirror including p-type transistors $MP_1$ and $MP_2$, NPN BJT transistors $Q_1$ and $Q_2$, p-type feedback transistor $MP_3$, p-type CTAT transistor $MP_4$, p-type PTAT transistor $MP_5$, and resistive devices $R_1$, $R_2$, and $R_3$ coupled together as shown. In some embodiments, resistive devices $R_1$, $R_2$, and $R_3$ are implemented as discrete resistors. In some embodiments, resistive devices $R_1$, $R_2$, and $R_3$ are implemented as transistors operating in active region. In some embodiments, resistive devices $R_1$, $R_2$, and $R_3$ are implemented using special resistive devices available in a process technology node.

In some embodiments, transistor $MP_1$ is diode-connected with its gate terminal coupled to the gate terminal of transistor $MP_2$ at node n1. In some embodiments, the source terminal of transistor $MP_1$ is coupled to a first reference node (e.g., positive power supply Vdd). In some embodiments, node n1 is coupled to the collector of NPN BJT $Q_1$ and also to the gate terminal of transistor $MP_5$. In some embodiments, the emitter of NPN BJT $Q_1$ is coupled to a second reference node (e.g., ground supply). In some embodiments, the source terminal of transistor $MP_2$ is coupled to the first reference supply node, and the drain terminal of transistor $MP_2$ is coupled to node n2 which is coupled to the gate terminals of transistors $MP_3$ and $MP_4$ and collector of NPN BJT $Q_2$. In some embodiments, the base terminals of NPN BJTs $Q_1$ and $Q_2$ are coupled to node nb which is also coupled to resistive device $R_2$. In some embodiments, the emitter of NPN BJT $Q_2$ is coupled to resistive device $R_1$.

In some embodiments, the source terminals of transistors $MP_4$ and $MP_5$ are coupled to the first reference node while the drain terminals of transistors $MP_4$ and $MP_5$ are coupled to the Vref node which is also coupled to resistive device $R_3$. Here, one terminal of resistive devices $R_1$, $R_2$ and $R_3$ is coupled to nodes nb and Vref, respectively, while the other terminal of resistive devices $R_1$, $R_2$ and $R_3$ is coupled to the second reference node. In various embodiments of FIG. 3A, transistors $MP_1$ and $MP_2$ have the same size (e.g., 1:1 ratio of W/L (width/length) of the devices $MP_1$ and $MP_2$) while NPN transistors $Q_1$ and $Q_2$ have different current densities because the area of NPN transistor $Q_2$ is N times larger than the area of NPN transistor $Q_1$. As such, the two NPN devices ($Q_1$, $Q_2$), are biased with different current densities (1:N), where 'N' is a number.

The current densities of the two NPN devices ($Q_1$, $Q_2$) can be adjusted by changing the area of those devices. For example, a larger NPN device will result in lower current density. In some embodiments, in realizing the core bandgap function, BJT's $Q_1$ and $Q_2$ are combined as pseudo-differential and asymmetric differential pair, together with p-type transistors $MP_1$/$MP_2$ as active load. In some embodiments, the feedback loop around transistor $MP_3$ establishes not only a precise PTAT current in the differential pair, which is defined by resistor $R_1$ and delta-Vbe ($Q_1$, $Q_2$), it also drives resistive device $R_2$ and the base currents for transistors $Q_1$/$Q_2$, adjusting automatically to any value of beta. The current into the shunt resistive device $R_2$ is CTAT (e.g., negative temperature coefficient), in accordance with some embodiments.

In some embodiments, replicas of both CTAT current (e.g., current $I_3$ from transistor $MP_4$) and PTAT current (e.g., current from transistor $MP_5$) are combined into resistive device $R_3$, to generate the bandgap reference, which is nearly flat over temperature. The summing of current occurs on node Vref, in accordance with various embodiments. Here, labels for nodes and signals are interchangeable. For example, the term "Vref" may refer to the voltage Vref or node Vref depending on the context of the sentence.

Vref is not dependent on the resistances $R_1$, $R_2$, or $R_3$ nor on process variations, in accordance with various embodiments. Note, Vref is generated outside of the feedback loop of circuit 300. In various embodiments, the temperature coefficient is adjusted by the ratio of resistances $R_1$/$R_2$, and the output voltage level can be chosen independently by resistive device $R_3$. As such, in various embodiments, a specific ratio "X" for the replica currents is used to compensate the impact of (uncertain) BJT base current, and the ratio can be expressed as:

$$MP_1(MP_2):MP_5=1:2X, \text{ and } MP_3:MP_4=1:X$$

The simplicity of this solution is an advantage which enables lowest supply and overall robustness.

Due to the large transconductance gm and physics of NPN transistors, acting here as input devices, circuit 300 of various embodiments achieves superior performance compared to a MOS amplifier. In various embodiments, the offset is negligible, and intrinsic noise is minimized (both flicker and thermal noise). For the sake of simplicity, here it is assumed that the BJT (area) ratio is 1:N, and current $I_1$ is equal to current $I_2$ ($I_1$=$I_2$), although different current densities can be implemented through transistor ratio $MP_1$/$MP_2$ greater or smaller than 1. A person skilled in the art would appreciate that transistor ratio here refers to the ratio of width/Length (W/L) of the transistor. Here, it is also presumed that base currents $Ib_1$=$Ib_2$=Ib (equal gain factor β of BJTs $Q_1$ and $Q_2$). The following equations illustrate the operation of circuit 300.

$$Iptat = I_{1,2} = Ie(Q_2) - Ib = \frac{\Delta Vbe}{R_1} - Ib = \frac{\eta \cdot Vt \cdot \ln(N)}{R_1} - Ib$$

With η=NPN ideality factor; Vt=thermal voltage $$Ictat = I_3 = \frac{Vbe1}{R_2} + 2 \cdot Ib$$

$Vref = I_4 \cdot R_3 = (2 \cdot Iptat + Ictat) \cdot X$ (replica ratios of $MP_5$, $MP_4$)

$$Vref = \left(\frac{2 \cdot \eta \cdot Vt \cdot \ln(N)}{R_1} + \frac{Vbe1}{R_2}\right) \cdot R_3 \cdot X$$

From the formula of Vref, it is clear that the temperature coefficient of Vt and Vbe can be balanced through the selection of resistances $R_1/R_2$, and that the base current is cancelled out. In some embodiments, current and voltage level in the output branch may be freely selected through $R_3$ and factor X. The Vref node is insensitive to capacitive load, since outside of feedback loop, in accordance with various embodiments.

Circuit 320 of FIG. 3B is similar to circuit 300 of FIG. 3A except for different ratios of transistors $MP_1$ and $MP_2$ and same ratios for NPN transistors $Q_1$ and $Q_2$. This is another mechanism for generating different current densities through NPN transistors $Q_1$ and $Q_2$. In this example, the $I_2$ is N times $I_1$.

Figure 4A:
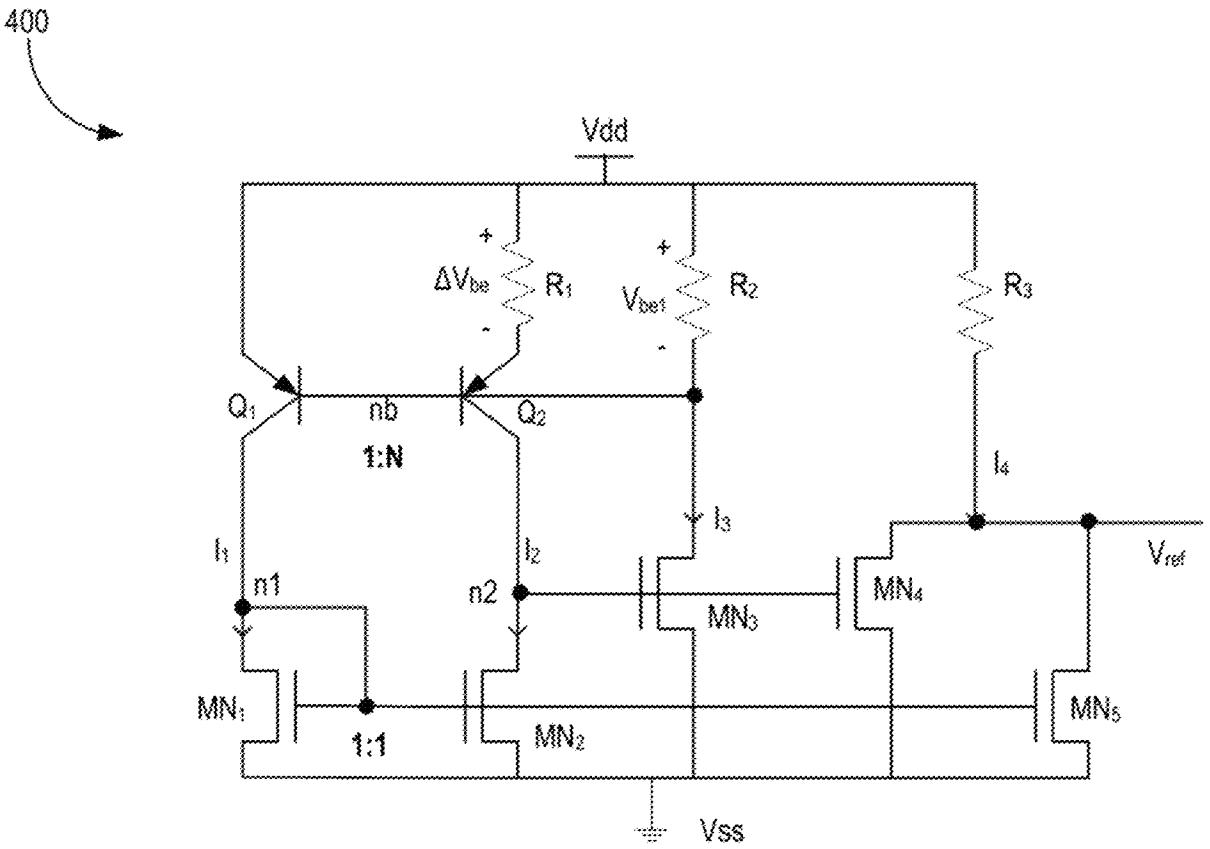
FIGS. 4A-B illustrate low noise sub-1V BVRs using PNP bi-polar junction transistors (BJTs), respectively, according to some embodiments of the disclosure.
Figure 4B:
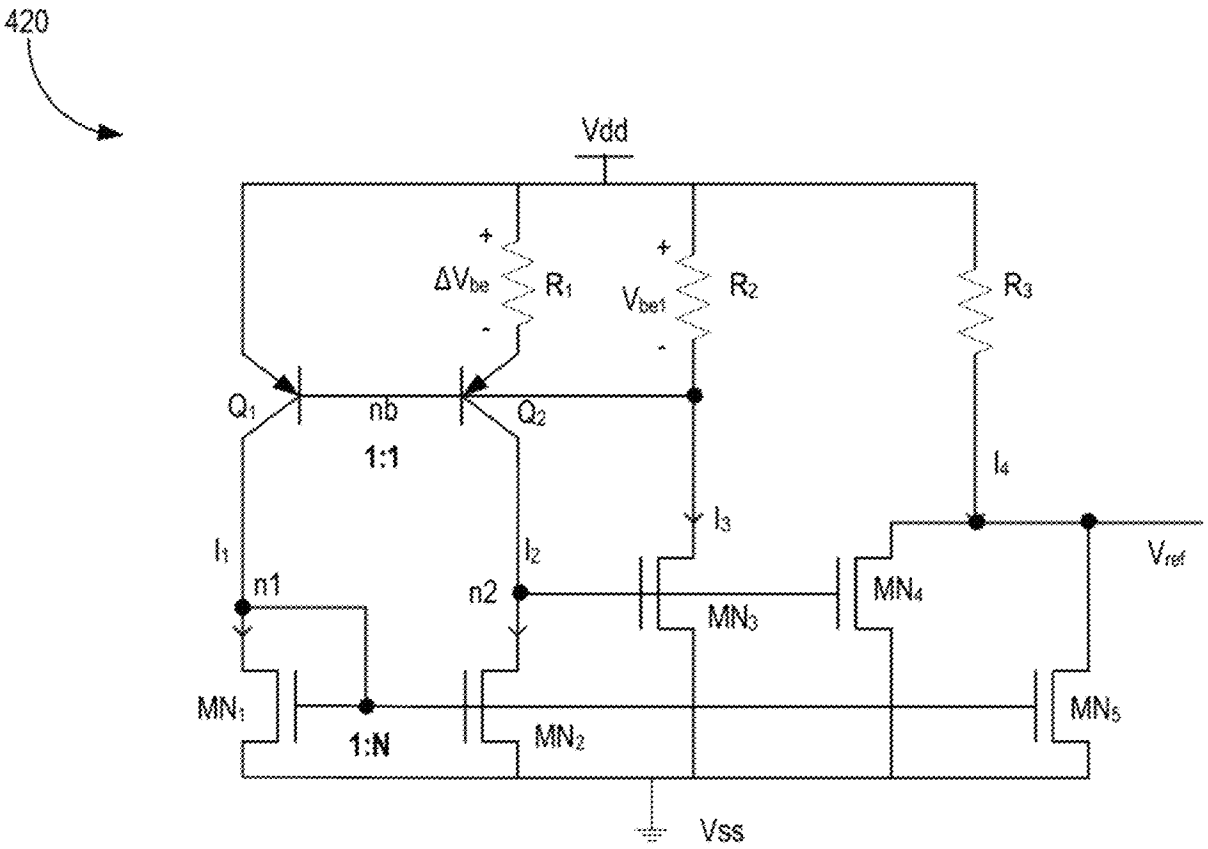

FIGS. 4A-B illustrate low-noise sub-1V bandgap reference circuits 400 and 420 using PNP BJTs, respectively, according to some embodiments of the disclosure.

In some embodiments, bandgap reference circuit 400 generates a positive supply (Vdd) referenced reference voltage Vref, and comprises a current mirror including n-type transistors $MN_1$ and $MN_2$, PNP BJT transistors $Q_1$ and $Q_2$, n-type feedback transistor $MN_3$, n-type CTAT transistor $MN_4$, n-type PTAT transistor $MN_5$, and resistive devices $R_1$, $R_2$, and $R_3$ coupled together as shown.

In some embodiments, transistor $MN_1$ is diode-connected with its gate terminal coupled to the gate terminal of transistor $MN_2$ at node n1. In some embodiments, the source terminal of transistor $MN_1$ is coupled to a first reference node (e.g., ground supply Vss). In some embodiments, node n1 is coupled to the collector of PNP BJT $Q_1$ and also to the gate terminal of transistor $MN_5$. In some embodiments, the emitter of PNP BJT $Q_1$ is coupled to a second reference node (e.g., positive power supply). In some embodiments, the source terminal of transistor $MN_2$ is coupled to the first reference supply node, and the drain terminal of transistor $MN_2$ is coupled to node n2 which is coupled to the gate terminals of transistors $MN_3$ and $MN_4$ and collector of PNP BJT $Q_2$. In some embodiments, the base terminals of PNP BJTs $Q_1$ and $Q_2$ are coupled to node nb which is also coupled to resistive device $R_2$. In some embodiments, the emitter of PNP BJT $Q_2$ is coupled to resistive device $R_1$.

In some embodiments, the source terminals of transistors $MN_4$ and $MN_5$ are coupled to the first reference node while the drain terminals of transistors $MN_4$ and $MN_5$ are coupled to the Vref node which is also coupled to resistive device $R_3$. Here, one terminal of resistive devices $R_1$, $R_2$ and $R_3$ is coupled to nodes nb and Vref, respectively, while the other terminal of resistive devices $R_1$, $R_2$ and $R_3$ is coupled to the second reference node. In various embodiments of FIG. 4A, transistors $MN_1$ and $MN_2$ have the same size (e.g., 1:1 ratio of W/L of the devices $MN_1$ and $MN_2$) while PNP transistors $Q_1$ and $Q_2$ have different current densities because the area of PNP transistor $Q_2$ is N times larger than the area of PNP transistor $Q_1$. As such, the two PNP devices ($Q_1$, $Q_2$), are biased with different current densities (1:N).

The current densities of the two PNP devices ($Q_1$, $Q_2$) can be adjusted by changing the area of those devices. For example, a larger PNP device will result in lower current density. In some embodiments, in realizing the core bandgap function, PNP BJT's $Q_1$ and $Q_2$ are combined as pseudo-differential and asymmetric differential pair, together with n-type transistors $MN_1/MN_2$ as active load. In some embodiments, the feedback loop around transistor $MN_3$ establishes not only a precise PTAT current in the differential pair, which is defined by resistor $R_1$ and delta-Vbe ($Q_1$, $Q_2$), it also drives resistive device $R_2$ and the base currents for $Q_1/Q_2$, adjusting automatically to any value of beta. The current into shunt resistive device $R_2$ is CTAT (e.g., negative temperature coefficient), in accordance with some embodiments.

In some embodiments, replicas of both CTAT current (e.g., current $I_3$ from transistor $MN_4$) and PTAT current (e.g., current from transistor $MN_5$) are combined into resistive device $R_3$, to generate the bandgap reference, which is nearly flat over temperature. The summing of current occurs on node Vref. The voltage Vref on that node (Vref node) is not dependent on the resistances $R_1$, $R_2$, or $R_3$ nor on process variations, in accordance with various embodiments. Note, Vref is referenced to the positive (second) supply node, and generated outside of the feedback loop of circuit 400. In various embodiments, the temperature coefficient is adjusted by ratio of resistances $R_1/R_2$, and the output voltage level can be chosen independently by resistive device $R_3$. As such, in various embodiments, a specific ratio "X" for the replica currents is used to compensate the impact of (uncertain) BJT base current, and the ratio can be expressed as:

$$MN_1(MN_2):MN_5 = 1:2X, \text{ and } MN_3:MN_4 = 1:X$$

The simplicity of this solution is an advantage which enables lowest supply and overall robustness.

Due to the large transconductance gm and physics of PNP transistors, acting here as input devices, circuit 400 of various embodiments achieves superior performance compared to a MOS amplifier. In various embodiments, the offset is negligible, and intrinsic noise is minimized (both flicker and thermal noise). For sake of simplicity, here it is assumed that the PNP BJT (area) ratio is 1:N, and current $I_1$ is equal to current $I_2$ ($I_1=I_2$), although different current densities can be implemented through transistor $MN_1/MN_2$ ratio greater or smaller than 1. A person skilled in the art would appreciate that transistor ratio here refers to the ratio of width/Length (W/L) of the transistor. Here, it is also presumed that base currents $Ib_1=Ib_2=Ib$ (equal gain factor β of BJTs $Q_1$ and $Q_2$). The temperature coefficient of Vt and Vbe can be balanced through selection of resistances $R_1/R_2$, and that the base current is cancelled out. In some embodiments, current and voltage level in the output branch may by freely selected through $R_3$ and factor X. The Vref node is insensitive to capacitive load, since outside of feedback loop, in accordance with various embodiments.

Circuit 420 of FIG. 4B is similar to circuit 400 of FIG. 4A except for different ratios of transistors $MN_1$ and $MN_2$ and same ratios for PNP transistors $Q_1$ and $Q_2$. This is another mechanism for generating different current densities through PNP transistors $Q_1$ and $Q_2$. In this example, the $I_2$ is N times $I_1$.

Figure 5:
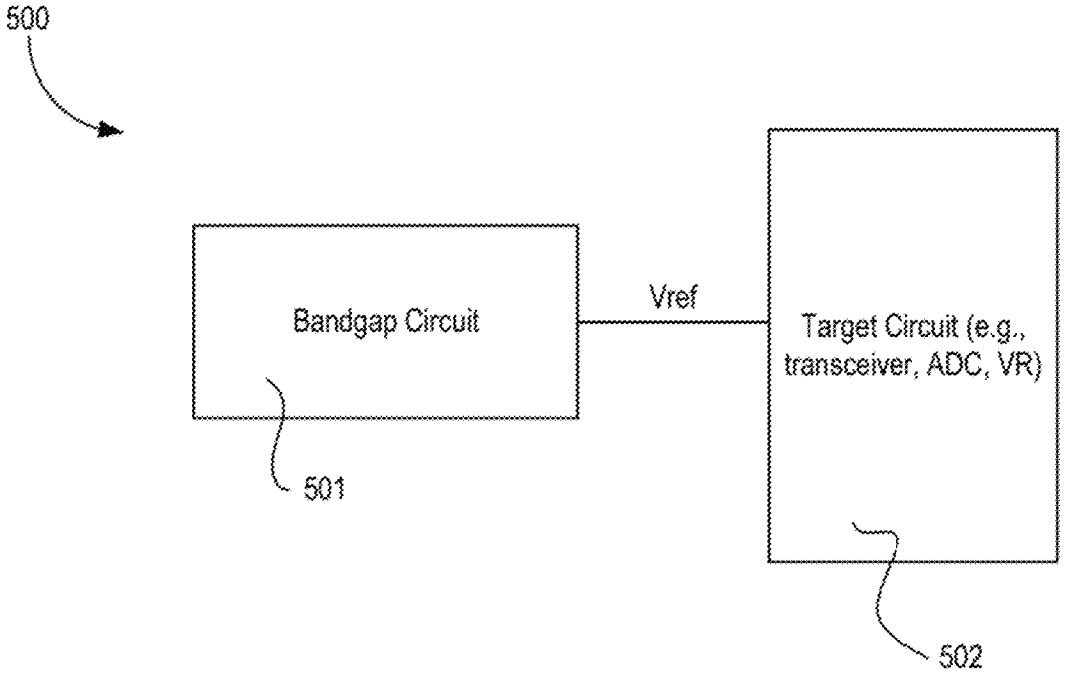
FIG. 5 illustrates an application of the low noise sub-1V BVR, in accordance with some embodiments.

FIG. 5 illustrates an application 500 of the low noise sub-1V bandgap reference circuit, in accordance with some embodiments. In some embodiments, bandgap circuit 501 (e.g., 300, 320, 400, or 420) generates a low noise sub-1V bandgap reference Vref for any target circuit 502 needing a stable reference. For example, low voltage wireless systems operating at high frequencies need a low-noise sub-1V bandgap reference for its transceivers to sample incoming data. In another example, flash ADCs can use the low noise sub-1V bandgap reference Vref for generating corresponding digital signals from analog input signals. In another example, a voltage regulator (e.g., a DC-DC converter, buck converter, boost converter, low dropout (LDO) converter) can use the low-noise sub-1V bandgap reference for its comparator.

Figure 6:
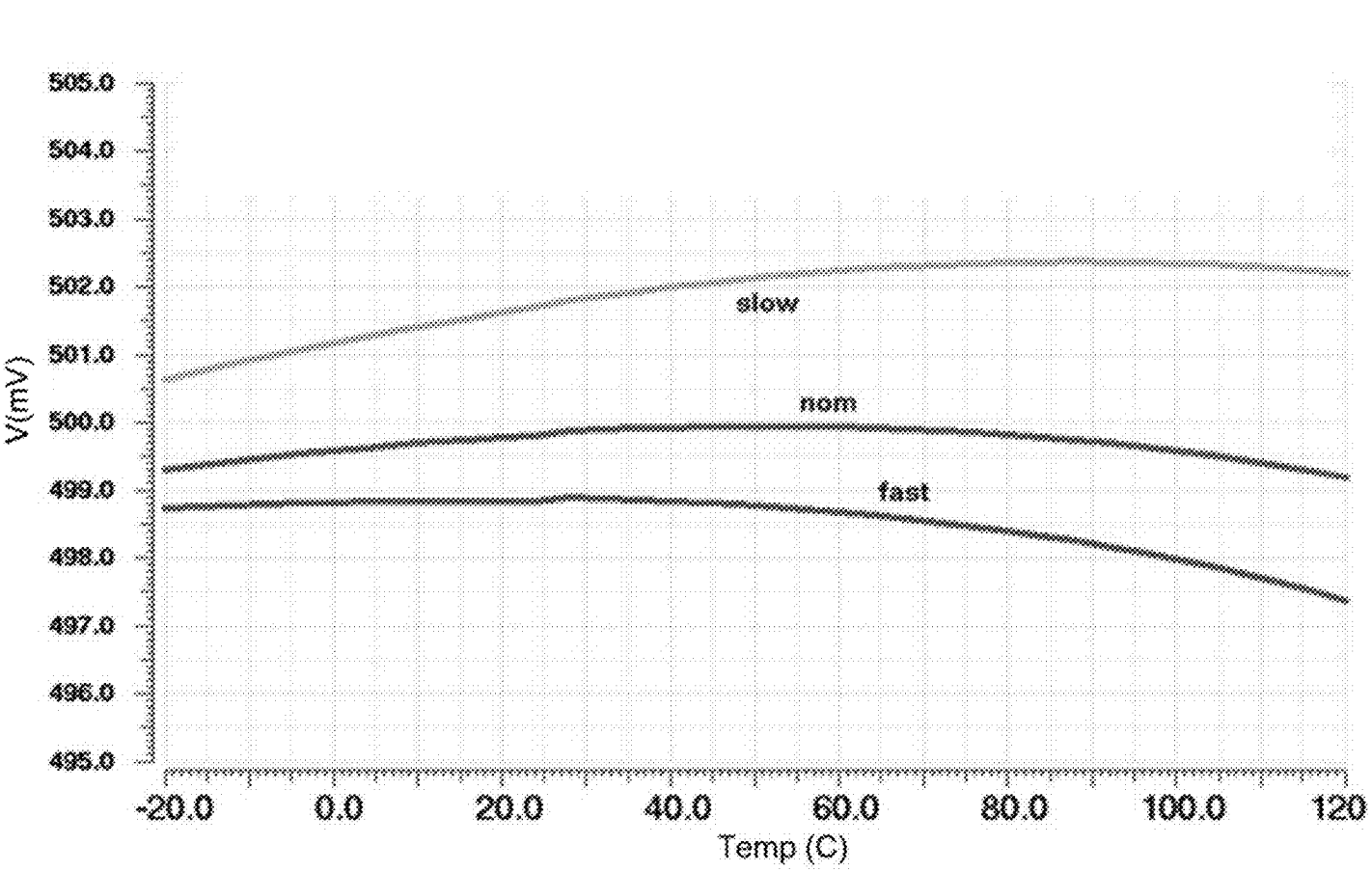
FIG. 6 illustrates a plot showing a reference output versus temperature and process for the BVR of FIG. 3A, according to some embodiments of the disclosure.

FIG. 6 illustrates plot 600 showing a reference output versus temperature and process for the bandgap reference circuit of FIG. 3A, according to some embodiments of the disclosure. The DC sweep versus temperature shows that Vref output (e.g., 500 mV) is quite stable versus process (merely Vbe spread). Impact of beta and MOS parameters is removed, according to various embodiments. Here, Vref output varies justly slightly with process (e.g., sheet resistance, Vbe spread).

Figure 7:
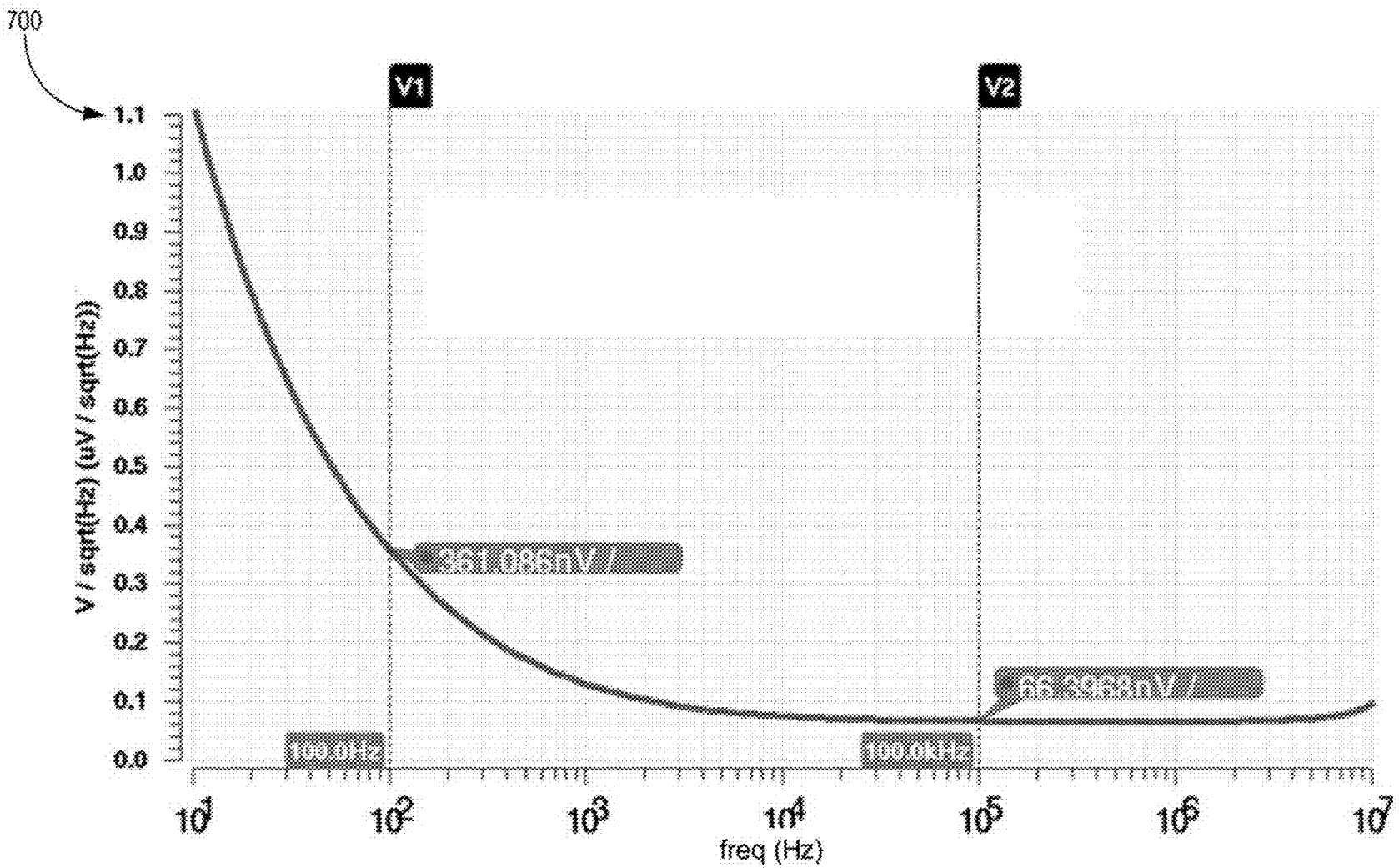
FIG. 7 illustrates a plot showing noise performance for the BVR of FIG. 3A, according to some embodiments of the disclosure.

FIG. 7 illustrates plot 700 showing noise performance for the bandgap reference circuit of FIG. 3A, according to some embodiments of the disclosure. The plot of FIG. 7 shows small signal noise of Vref output. Here, very low noise figure is realized with smallest area and power consumption.

Figure 8:
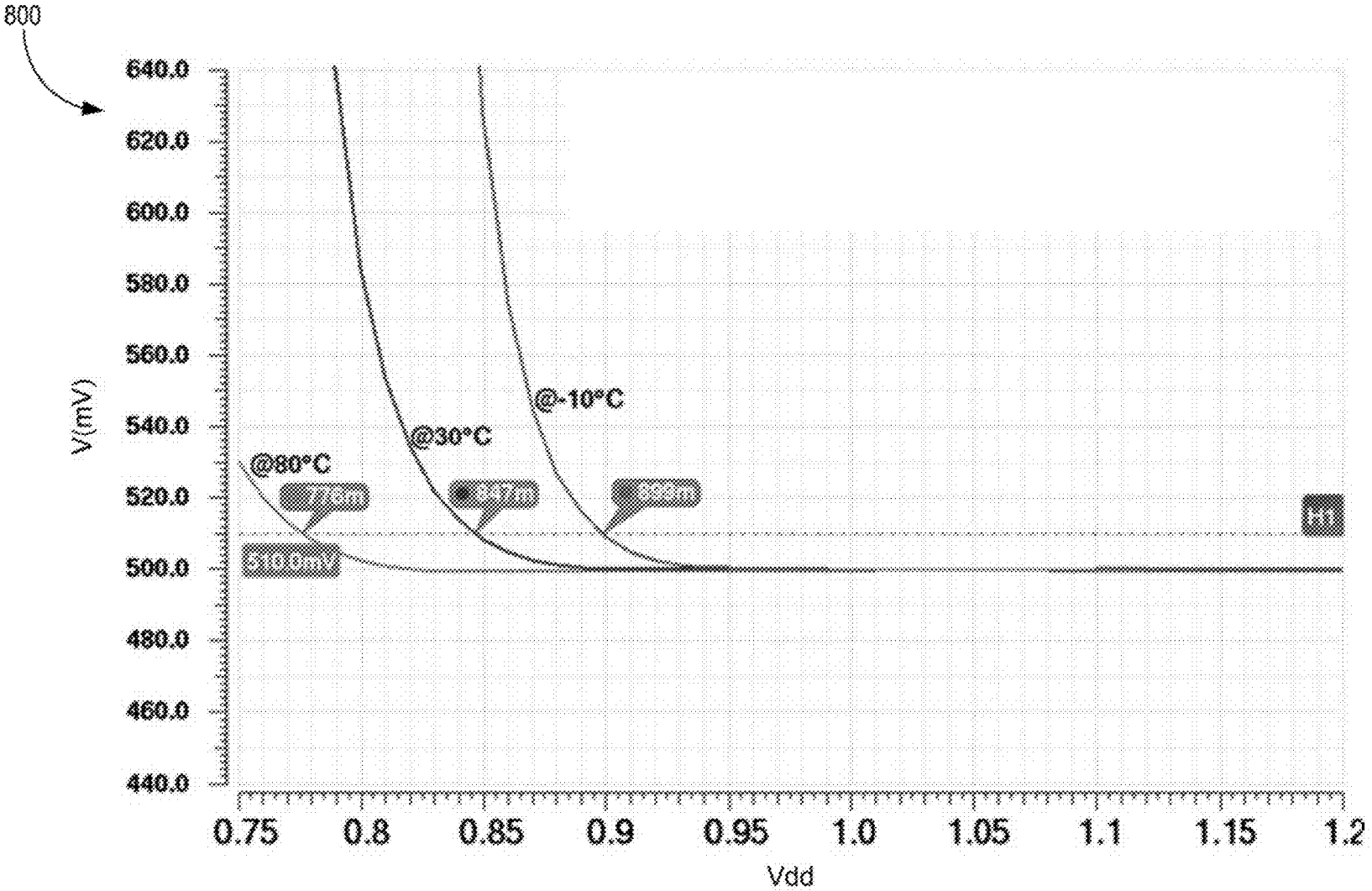
FIG. 8 illustrates a plot showing power supply rejection ratio (PSRR) versus supply voltage for the BVR of FIG. 3A, according to some embodiments of the disclosure.

FIG. 8 illustrates plot 800 showing power supply rejection ratio (PSRR) versus supply voltage for the bandgap reference circuit of FIG. 3A, according to some embodiments of the disclosure. Plot 800 shows that excellent DC-PSRR is achieved down to low Vdd of approximately 0.80 V, which is Sub-1V operation.

Figure 9:
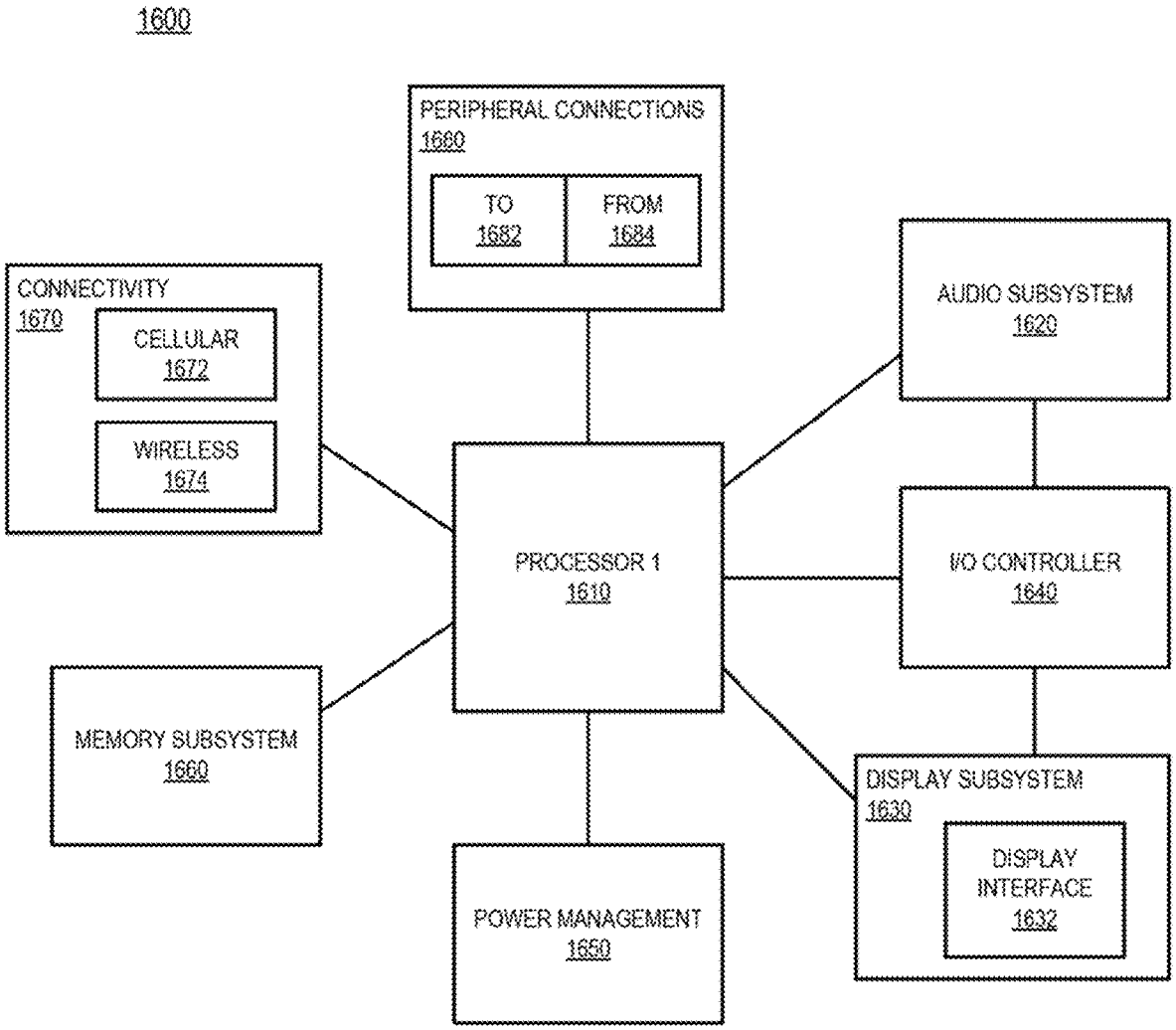
FIG. 9 illustrates a smart device or a computer system or a SoC (System-on-Chip) having a BVR, according to some embodiments of the disclosure.

FIG. 9 illustrates a smart device or a computer system or a SoC (System-on-Chip) having a bandgap reference circuit, according to some embodiments of the disclosure. The block diagram is, for example, of an embodiment of a mobile device in which flat surface interface connectors could be used. In some embodiments, computing device 1600 represents a mobile computing device, such as a computing tablet, a mobile phone or smart-phone, a wireless-enabled e-reader, or other wireless mobile device. It will be understood that certain components are shown generally, and not all components of such a device are shown in computing device 1600.

In some embodiments, computing device 1600 includes first processor 1610 having the bandgap reference circuit, according to some embodiments discussed. Other blocks of the computing device 1600 may also include the bandgap reference circuit, according to some embodiments. The various embodiments of the present disclosure may also comprise a network interface within 1670 such as a wireless interface so that a system embodiment may be incorporated into a wireless device, for example, cell phone or personal digital assistant.

In some embodiments, processor 1610 (and/or processor 1690) can include one or more physical devices, such as microprocessors, application processors, microcontrollers, programmable logic devices, or other processing means. The processing operations performed by processor 1610 include the execution of an operating platform or operating system on which applications and/or device functions are executed. The processing operations include operations related to I/O (input/output) with a human user or with other devices, operations related to power management, and/or operations related to connecting the computing device 1600 to another device. The processing operations may also include operations related to audio I/O and/or display I/O.

In some embodiments, computing device 1600 includes audio subsystem 1620, which represents hardware (e.g., audio hardware and audio circuits) and software (e.g., drivers, codecs) components associated with providing audio functions to the computing device. Audio functions can include speaker and/or headphone output, as well as microphone input. Devices for such functions can be integrated into computing device 1600, or connected to the computing device 1600. In one embodiment, a user interacts with the computing device 1600 by providing audio commands that are received and processed by processor 1610.

In some embodiments, computing device 1600 comprises display subsystem 1630. Display subsystem 1630 represents hardware (e.g., display devices) and software (e.g., drivers) components that provide a visual and/or tactile display for a user to interact with the computing device 1600. Display subsystem 1630 includes display interface 1632, which includes the particular screen or hardware device used to provide a display to a user. In one embodiment, display interface 1632 includes logic separate from processor 1610 to perform at least some processing related to the display. In one embodiment, display subsystem 1630 includes a touch screen (or touch pad) device that provides both output and input to a user.

In some embodiments, computing device 1600 comprises I/O controller 1640. I/O controller 1640 represents hardware devices and software components related to interaction with a user. I/O controller 1640 is operable to manage hardware that is part of audio subsystem 1620 and/or display subsystem 1630. Additionally, I/O controller 1640 illustrates a connection point for additional devices that connect to computing device 1600 through which a user might interact with the system. For example, devices that can be attached to the computing device 1600 might include microphone devices, speaker or stereo systems, video systems or other display devices, keyboard or keypad devices, or other I/O devices for use with specific applications such as card readers or other devices.

As mentioned above, I/O controller 1640 can interact with audio subsystem 1620 and/or display subsystem 1630. For example, input through a microphone or other audio device can provide input or commands for one or more applications or functions of the computing device 1600. Additionally, audio output can be provided instead of, or in addition to display output. In another example, if display subsystem 1630 includes a touch screen, the display device also acts as an input device, which can be at least partially managed by I/O controller 1640. There can also be additional buttons or switches on the computing device 1600 to provide I/O functions managed by I/O controller 1640.

In some embodiments, I/O controller 1640 manages devices such as accelerometers, cameras, light sensors or other environmental sensors, or other hardware that can be included in the computing device 1600. The input can be part of direct user interaction, as well as providing environmental input to the system to influence its operations (such as filtering for noise, adjusting displays for brightness detection, applying a flash for a camera, or other features).

In some embodiments, computing device 1600 includes power management 1650 that manages battery power usage, charging of the battery, and features related to power saving operation. Memory subsystem 1660 includes memory devices for storing information in computing device 1600. Memory can include nonvolatile (state does not change if power to the memory device is interrupted) and/or volatile (state is indeterminate if power to the memory device is interrupted) memory devices. Memory subsystem 1660 can store application data, user data, music, photos, documents, or other data, as well as system data (whether long-term or temporary) related to the execution of the applications and functions of the computing device 1600.

Elements of embodiments are also provided as a machine-readable medium (e.g., memory 1660) for storing the computer-executable instructions (e.g., instructions to implement any other processes discussed herein). The machine-readable medium (e.g., memory 1660) may include, but is not limited to, flash memory, optical disks, CD-ROMs, DVD ROMs, RAMs, EPROMs, EEPROMs, magnetic or optical cards, phase change memory (PCM), or other types of machine-readable media suitable for storing electronic or computer-executable instructions. For example, embodiments of the disclosure may be downloaded as a computer program (e.g., BIOS) which may be transferred from a remote computer (e.g., a server) to a requesting computer (e.g., a client) by way of data signals via a communication link (e.g., a modem or network connection).

In some embodiments, computing device 1600 comprises connectivity 1670. Connectivity 1670 includes hardware devices (e.g., wireless and/or wired connectors and communication hardware) and software components (e.g., drivers, protocol stacks) to enable the computing device 1600 to communicate with external devices. The computing device 1600 could be separate devices, such as other computing devices, wireless access points or base stations, as well as peripherals such as headsets, printers, or other devices.

Connectivity 1670 can include multiple different types of connectivity. To generalize, the computing device 1600 is illustrated with cellular connectivity 1672 and wireless connectivity 1674. Cellular connectivity 1672 refers generally to cellular network connectivity provided by wireless carriers, such as provided via GSM (global system for mobile communications) or variations or derivatives, CDMA (code division multiple access) or variations or derivatives, TDM (time division multiplexing) or variations or derivatives, or other cellular service standards. Wireless connectivity (or wireless interface) 1674 refers to wireless connectivity that is not cellular, and can include personal area networks (such as Bluetooth, Near Field, etc.), local area networks (such as Wi-Fi), and/or wide area networks (such as WiMax), or other wireless communication.

In some embodiments, computing device 1600 comprises peripheral connections 1680. Peripheral connections 1680 include hardware interfaces and connectors, as well as software components (e.g., drivers, protocol stacks) to make peripheral connections. It will be understood that the computing device 1600 could both be a peripheral device ("to" 1682) to other computing devices, as well as have peripheral devices ("from" 1684) connected to it. The computing device 1600 commonly has a "docking" connector to connect to other computing devices for purposes such as managing (e.g., downloading and/or uploading, changing, synchronizing) content on computing device 1600. Additionally, a docking connector can allow computing device 1600 to connect to certain peripherals that allow the computing device 1600 to control content output, for example, to audiovisual or other systems.

In addition to a proprietary docking connector or other proprietary connection hardware, the computing device 1600 can make peripheral connections 1680 via common or standards-based connectors. Common types can include a Universal Serial Bus (USB) connector (which can include any of a number of different hardware interfaces), DisplayPort including MiniDisplayPort (MDP), High Definition Multimedia Interface (HDMI), Firewire, or other types.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may," "might," or "could" be included, that particular component, feature, structure, or characteristic is not required to be included. If the specification or claim refers to "a" or "an" element, that does not mean there is only one of the elements. If the specification or claims refer to "an additional" element, that does not preclude there being more than one of the additional element.

Furthermore, the particular features, structures, functions, or characteristics may be combined in any suitable manner in one or more embodiments. For example, a first embodiment may be combined with a second embodiment anywhere the particular features, structures, functions, or characteristics associated with the two embodiments are not mutually exclusive.

While the disclosure has been described in conjunction with specific embodiments thereof, many alternatives, modifications and variations of such embodiments will be apparent to those of ordinary skill in the art in light of the foregoing description. The embodiments of the disclosure are intended to embrace all such alternatives, modifications, and variations as to fall within the broad scope of the appended claims.

In addition, well known power/ground connections to integrated circuit (IC) chips and other components may or may not be shown within the presented figures, for simplicity of illustration and discussion, and so as not to obscure the disclosure. Further, arrangements may be shown in block diagram form in order to avoid obscuring the disclosure, and also in view of the fact that specifics with respect to implementation of such block diagram arrangements are highly dependent upon the platform within which the present disclosure is to be implemented (i.e., such specifics should be well within purview of one skilled in the art). Where specific details (e.g., circuits) are set forth in order to describe example embodiments of the disclosure, it should be apparent to one skilled in the art that the disclosure can be practiced without, or with variation of, these specific details. The description is thus to be regarded as illustrative instead of limiting.

The following examples pertain to further embodiments. Specifics in the examples may be used anywhere in one or more embodiments. All optional features of the apparatus described herein may also be implemented with respect to a method or process.

Example 1

An apparatus comprising: a first supply node; a second supply node; a first transistor coupled to the first supply node, wherein the first transistor is to provide a first current which is complementary to absolute temperature (CTAT); a second transistor coupled to the first supply node, wherein the second transistor is to provide a second current which is proportional to absolute temperature (PTAT); a resistive device coupled in series at a node with the first and second transistors, and coupled to the second supply node, wherein the node is to sum the CTAT and the PTAT currents.

Example 2

The apparatus of example 1 comprises: a current mirror coupled to the first supply node and the first and second transistors; and a pair of bi-polar junction devices coupled in series with the current mirror, wherein a first of the bi-polar junction devices of the pair is connected to the second supply node.

Example 3

The apparatus of example 2 comprises a second resistive device coupled to an emitter of a second of the bi-polar junction devices of the pair, and coupled to the second supply node.

Example 4

The apparatus according to any one of examples 1 to 3, wherein the current mirror comprises a third transistor which is diode-connected, and a fourth transistor with a gate coupled to a gate of the third transistor.

Example 5

The apparatus of example 4, wherein the gates of the third and fourth transistors are coupled to a gate of the second transistor.

Example 6

The apparatus of example 5 comprises: a fifth transistor coupled to the first supply node; and a third resistive device coupled in series at a second node with the fifth transistor and coupled to the second supply node, wherein the second node is coupled to the pair of bi-polar junction devices.

Example 7

The apparatus of example 6, wherein a gate of the first transistor is coupled to a gate of the fifth transistor.

Example 8

The apparatus according to any one of examples 1 to 7, wherein the first supply node is a power supply node, wherein the second supply node is a ground node, wherein the first and second transistors are n-type transistors, and wherein the pair of bi-polar junction devices are NPN BJTs.

Example 9

The apparatus according to any one of examples 1 to 7, wherein the first supply node is a ground node, wherein the second supply node is a power supply node, wherein the first and second transistors are p-type transistors, and wherein the pair of bi-polar junction devices are PNP BJTs.

Example 10

The apparatus according to any one of examples 1 to 9, wherein the first supply node is a power supply node which is to provide a power supply less than 1 V, and wherein the second supply node is a ground.

Example 11

An apparatus comprising: a current mirror coupled to a first power supply node; a pair or bi-polar junction devices coupled to the current mirror; a transistor coupled to the first power supply node, the current mirror, and the pair of bi-polar junction devices such that the transistor is to be biased by a feedback electrical path comprising the current mirror and the pair or bi-polar junction devices; and a resistor coupled in series with the transistor, and to a second supply node.

Example 12

The apparatus of example 11 comprises: a second transistor coupled to the first supply node and is to be biased by the feedback electrical path, the second transistor is to provide a first current which is complementary to absolute temperature (CTAT); and a third transistor coupled to the first supply node, the third transistor is to provide a second current which is proportional to absolute temperature (PTAT).

Example 13

The apparatus according to any one of examples 11 to 12, comprises a resistive device coupled in series at a node with the second and third transistors, and coupled to the second supply node, wherein the first and second currents are to be added at the node.

Example 14

An apparatus comprising: a first circuitry to provide a first current which is complementary to absolute temperature (CTAT); a second circuitry to provide a second current which is proportional to absolute temperature (PTAT); and a node to sum the first and second currents and to provide a bandgap reference voltage which is to be less than 1 V.

Example 15

The apparatus of example 14 comprises a resistive device coupled in series with the first and second transistors.

Example 16

The apparatus of example 14, wherein the first and second circuitries are to operate on a power supply less than 1 V.

Example 17

The apparatus of example 14 comprises a third circuitry coupled to the node and to receive the reference voltage.

Example 18

The apparatus of example 17, wherein the third circuitry is one of: a voltage regulator, an analog-to-digital converter, or a transceiver.

Example 19

A system comprising: a memory; a processor coupled to the memory, the processor including a bandgap reference circuit which includes an apparatus according to any one of examples 1 to 10; and a wireless interface to allow the processor to communicate with another device.

Example 20

A system comprising: a memory; a processor coupled to the memory, the processor including a bandgap reference circuit which includes an apparatus according to any one of examples 11 to 13; and a wireless interface to allow the processor to communicate with another device.

Example 21

A system comprising: a memory; a processor coupled to the memory, the processor including a bandgap reference circuit which includes an apparatus according to any one of examples 14 to 18; and a wireless interface to allow the processor to communicate with another device.

Example 22

A method comprising: providing a first current which is complementary to absolute temperature (CTAT); providing a second current which is proportional to absolute temperature (PTAT); and summing the first and second currents to provide a bandgap reference voltage which is to be less than 1 V.

Example 23

The method of example 22 comprises operating on a power supply less than 1 V, wherein the bandgap reference voltage is received by one of: a voltage regulator, an analog-to-digital converter, or a transceiver.

Example 24

An apparatus comprising: means for providing a first current which is complementary to absolute temperature (CTAT); means providing a second current which is proportional to absolute temperature (PTAT); and summing the first and second currents to provide a bandgap reference voltage which is to be less than 1 V.

Example 25

The apparatus of example 24 comprises means for operating on a power supply less than 1 V.

Example 26

The apparatus of example 24, wherein the bandgap reference voltage is received by one of: a voltage regulator, an analog-to-digital converter, or a transceiver.

An abstract is provided that will allow the reader to ascertain the nature and gist of the technical disclosure. The abstract is submitted with the understanding that it will not be used to limit the scope or meaning of the claims. The following claims are hereby incorporated into the detailed description, with each claim standing on its own as a separate embodiment.

What is claimed is:

1. An apparatus comprising:

a first supply node;

a second supply node;

a first transistor coupled to the first supply node, wherein the first transistor is to provide a first current which is complementary to absolute temperature (CTAT);

a second transistor coupled to the first supply node, wherein the second transistor is to provide a second current which is proportional to absolute temperature (PTAT);

a resistive device coupled in series at a node with the first and second transistors, and coupled to the second supply node, wherein the node is to sum the CTAT and the PTAT currents; and a current mirror coupled to the first supply node and connected to the first and second transistors such that respective gate terminals of the first and second transistors are connected to separate nodes of the current mirror, wherein the separate nodes are connected to a same transistor of the current mirror.

2. The apparatus of claim 1 comprises:

a pair of bi-polar junction devices coupled in series with the current mirror, wherein a first of the bi-polar junction devices of the pair is connected to the second supply node.

3. The apparatus of claim 2 comprises a second resistive device coupled to an emitter of a second of the bi-polar junction devices of the pair, and coupled to the second supply node.

4. The apparatus of claim 2, wherein the current mirror comprises a third transistor which is diode-connected, and a fourth transistor with a gate coupled to a gate of the third transistor, and wherein the fourth transistor is the same transistor of the current mirror.

5. The apparatus of claim 4, wherein the gates of the third and fourth transistors are coupled to a gate of the second transistor.

6. The apparatus of claim 5 comprises:

a fifth transistor coupled to the first supply node; and a third resistive device coupled in series at a second node with the fifth transistor and coupled to the second supply node, wherein the second node is coupled to the pair of bi-polar junction devices.

7. The apparatus of claim 6, wherein a gate of the first transistor is coupled to a gate of the fifth transistor.

8. The apparatus of claim 2, wherein the first supply node is a power supply node, wherein the second supply node is a ground node, wherein the first and second transistors are p-type transistors, and wherein the pair of bi-polar junction devices are NPN BJTs.

9. The apparatus of claim 2, wherein the first supply node is a ground node, wherein the second supply node is a power supply node, wherein the first and second transistors are n-type transistors, and wherein the pair of bi-polar junction devices are PNP BJTs.

10. The apparatus of claim 1, wherein the first supply node is a power supply node which is to provide a power supply less than 1 V, and wherein the second supply node is a ground.

11. An apparatus comprising:

a current mirror coupled to a first power supply node;

a pair of bi-polar junction devices coupled to the current mirror;

a first transistor connected to the first power supply node, the current mirror, and the pair of bi-polar junction devices such that the first transistor is to be biased by a feedback electrical path comprising the current mirror and the pair of bi-polar junction devices;

a second transistor coupled to the first supply node and is to be biased by the feedback electrical path; and a resistor coupled in series with the first transistor, and to a second supply node wherein the first supply node is a power supply node which provides a power supply less than 1 V, and wherein the second supply node is a ground.

12. The apparatus of claim 11, wherein the second transistor is to provide a first current which is complementary to absolute temperature (CTAT); wherein the apparatus comprises:

a third transistor coupled to the first supply node, the third transistor is to provide a second current which is proportional to absolute temperature (PTAT).

13. The apparatus of claim 12 comprises a resistive device coupled in series at a node with the second and third transistors, and coupled to the second supply node, wherein the first and second currents are to be added at the node.

14. An apparatus comprising:

a first circuitry to provide a first current which is complementary to absolute temperature (CTAT);

a second circuitry to provide a second current which is proportional to absolute temperature (PTAT); and a node to sum the first and second currents and to provide a bandgap reference voltage which is to be less than 1 V, wherein the first and second circuitries comprises first and second transistors, respectively, which are connected to a current mirror such that respective gate terminals of the first and second transistors are connected to different nodes of the current mirror, and wherein the different nodes are connected to a same transistor of the current mirror.

15. The apparatus of claim 14 comprises a resistive device coupled in series with the first and second circuitries.

16. The apparatus of claim 14, wherein the first and second circuitries are to operate on a power supply less than 1 V.

17. The apparatus of claim 14 comprises a third circuitry coupled to the node and to receive the reference voltage.

18. The apparatus of claim 17, wherein the third circuitry is one of: a voltage regulator, an analog-to-digital converter, or a transceiver.

19. A reference generator apparatus, comprising:

a current mirror comprising a first p-type device and a second p-type device;

a first bi-polar junction transistor (BJT) connected to the first p-type device;

a first resistive device coupled in series with the second p-type device;

a second BJT coupled to the second p-type device such that the first resistive device is connected in series with the second BJT;

a third p-type device having a gate terminal connected to the second p-type device;

a second resistive device coupled to the third p-type device;

a fourth p-type device connected to the third p-type device;

a third resistive device coupled to the fourth p-type device; and a fifth p-type device coupled to the fourth p-type device, first and second p-type devices; and the third resistive device.

20. The apparatus of claim 19, wherein gate terminals of the first, second, and fifth p-type devices are coupled.

21. The apparatus of claim 19, wherein gate terminal of third and fourth p-type device are coupled to drain terminal of the second p-type device.

22. The apparatus of claim 19, wherein the first p-type device is diode connected, and wherein a drain of the third p-type device is coupled to base terminals of the first and second BJTs.

23. The apparatus of claim 19, wherein drain terminals of the fourth and fifth p-type devices are coupled to the third resistive device.

24. A reference generator apparatus, comprising:

a current mirror comprising a first n-type device and a second n-type device;

a first bi-polar junction transistor (BJT) connected to the first n-type device;

a first resistive device coupled in series with the second n-type device;

a second BJT coupled to the second n-type device such that the first resistive device is connected in series with the second BJT;

a third n-type device having a gate terminal connected to the second n-type device;

a second resistive device coupled to the third n-type device;

a fourth n-type device connected to the third n-type device;

a third resistive device coupled to the fourth n-type device; and a fifth n-type device coupled to the fourth n-type device, first and second n-type devices; and the third resistive device.

25. The apparatus of claim 24, wherein gate terminals of the first, second, and fifth n-type devices are coupled.

26. The apparatus of claim 24, wherein the gate terminal of third n-type device and a gate terminal of the fourth n-type device are coupled to drain terminal of the second n-type device.

27. The apparatus of claim 24, wherein the first n-type device is diode connected, and wherein a drain of the third n-type device is coupled to base terminals of the first and second BJTs.

28. The apparatus of claim 24, wherein drain terminals of the fourth and fifth n-type devices are coupled to the third resistive device.

29. The apparatus of claim 24, wherein a ratio of sizes of the first and second n-type devices are 1:1, and wherein a ratio of sizes of the first and second BJTs is 1:N.

30. The apparatus of claim 24, wherein a ratio of sizes of the first and second n-type devices are 1:N, and wherein a ratio of sizes of the first and second BJTs is 1:1.

* * * * *